US008366312B1

(12) United States Patent
Valdez et al.

(10) Patent No.: US 8,366,312 B1
(45) Date of Patent: Feb. 5, 2013

(54) SYSTEMS TO STORE AND AGITATE FUEL

(75) Inventors: Ruben Valdez, San Antonio, TX (US); Cindi Kathleen Scheele, Comfort, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 1529 days.

(21) Appl. No.: 11/461,510

(22) Filed: Aug. 1, 2006

(51) Int. Cl.
*B01F 13/02* (2006.01)

(52) U.S. Cl. ..... 366/104; 366/102; 366/107; 261/87

(58) Field of Classification Search ..... 261/77, 261/85, 87; 366/101–104, 106, 107, 168.2, 366/169.1, 170.3, 250
See application file for complete search history.

(56) References Cited

U.S. PATENT DOCUMENTS

| | | | | | |
|---|---|---|---|---|---|
| 5,561 | A | * | 5/1848 | Johnson et al. | 261/87 |
| 6,544 | A | * | 6/1849 | Francisco | 366/102 |
| 23,125 | A | * | 3/1859 | Thom | 261/87 |
| 41,024 | A | * | 12/1863 | Smith | 261/42 |
| 41,025 | A | * | 12/1863 | Smith | 426/474 |
| 52,268 | A | * | 1/1866 | Chapman | 366/164.2 |
| 53,876 | A | * | 4/1866 | Robinson | 366/164.2 |
| 94,730 | A | * | 9/1869 | Field | 261/87 |
| 105,751 | A | * | 7/1870 | Wikoff | 261/32 |
| 125,654 | A | * | 4/1872 | Hocking | 127/22 |
| 312,671 | A | * | 2/1885 | Tambling | 366/102 |
| 318,191 | A | * | 5/1885 | Leder | 366/102 |
| 404,425 | A | | 6/1889 | Obenchain | |
| 469,058 | A | * | 2/1892 | Currier | 127/15 |
| 485,986 | A | * | 11/1892 | Saladin | 366/102 |
| 503,577 | A | * | 8/1893 | Burnham, Jr. | 99/348 |
| 655,391 | A | * | 8/1900 | Cheney | 366/164.4 |
| 683,412 | A | * | 9/1901 | Perry | 366/102 |
| 700,033 | A | * | 5/1902 | Glatz | 210/219 |
| 812,460 | A | * | 2/1906 | Smith et al. | 366/102 |

(Continued)

FOREIGN PATENT DOCUMENTS

| | | | |
|---|---|---|---|
| DE | 4104621 | A1 * | 8/1992 |
| EP | 47921 | A1 * | 3/1982 |

(Continued)

OTHER PUBLICATIONS

Dancing Rabbit Ecovillage, Grassroots Biodiesel and Vegetable Oil Fuel Homepage, Running a diesel vehicle on straight vegetable oil (SVO); Jun. 2, 2006, 1 page.

(Continued)

*Primary Examiner* — Charles E Cooley
(74) *Attorney, Agent, or Firm* — Brooks, Cameron & Huebsch, PLLC

(57) ABSTRACT

Systems to store and agitate fuel can include a fuel storage tank including an air valve, and a fuel agitation system coupled to the fuel storage tank that can include an elongate fuel agitation member, a lumen, a plurality of valves extending from the elongate fuel agitation member, and an air passageway in fluid communication with the elongate fuel agitation member, where the air passageway is coupled to the first end of the elongate fuel agitation member by a rotational coupling located in the fuel storage tank that can be pneumatically actuated by air flow to rotate the elongate fuel agitation member as the air flow is introduced via the plurality of valves into the fuel storage tank, where the introduced air flow exits the fuel storage chamber out of the air valve.

17 Claims, 10 Drawing Sheets

U.S. PATENT DOCUMENTS 931,153 A * 8/1909 Silberhorn ..... 366/102
932,221 A * 8/1909 Winship ..... 366/102
950,152 A * 2/1910 Gaar ..... 366/164.4
1,106,736 A * 8/1914 Schuler ..... 198/676
1,156,946 A * 10/1915 Vandercook ..... 366/137
1,374,445 A * 4/1921 Greenawalt ..... 261/87
1,374,446 A * 4/1921 Greenawalt ..... 261/87
1,413,724 A 4/1922 Groch
1,450,326 A * 4/1923 Maitland ..... 366/102
1,493,987 A * 5/1924 Kenney ..... 68/55
1,526,596 A * 2/1925 Greenawalt ..... 261/93
RE16,314 E * 4/1926 Kenney ..... 68/55
1,633,708 A * 6/1927 Minogue ..... 261/87
1,635,936 A * 7/1927 Monroe ..... 141/102
1,653,607 A * 12/1927 Ackerman ..... 261/123
1,704,013 A * 3/1929 Minogue ..... 261/87
1,829,812 A * 11/1931 Rose ..... 366/169.1
1,853,067 A * 4/1932 Martin ..... 366/102
1,854,189 A * 4/1932 Grindrod ..... 426/580
2,031,590 A 2/1936 Daman
2,083,572 A 6/1937 McKee
2,341,185 A * 2/1944 McLean ..... 366/102
2,459,636 A * 1/1949 Fenney ..... 568/790
2,592,709 A * 4/1952 Kinnaird ..... 366/169.1
2,592,904 A * 4/1952 Jackson ..... 366/168.2
2,794,431 A 6/1957 Ginnow
2,800,315 A * 7/1957 Griesbach ..... 261/87
2,986,279 A 5/1961 Henigman
3,065,854 A 11/1962 Winslow
3,108,146 A * 10/1963 Gross ..... 261/24
3,171,807 A 3/1965 Neuman
3,650,513 A 3/1972 Werner
3,779,531 A * 12/1973 White ..... 261/87
3,900,397 A 8/1975 Bell
3,917,763 A 11/1975 Schafer
3,992,491 A 11/1976 Ihrig et al.
4,029,067 A 6/1977 Giammattei
4,097,026 A * 6/1978 Haindl ..... 366/165.2
4,166,704 A * 9/1979 Albert ..... 366/168.2
4,168,918 A * 9/1979 de Jonge ..... 366/138
4,179,220 A * 12/1979 Rippon ..... 366/102
4,371,480 A * 2/1983 Vos ..... 261/87
4,376,515 A * 3/1983 Soe ..... 241/101.8
4,501,500 A * 2/1985 Terrels ..... 366/250
4,522,158 A 6/1985 Wisegerber
4,717,515 A * 1/1988 Forsyth et al. ..... 261/122.1
4,772,401 A 9/1988 Rawlins
4,838,703 A * 6/1989 McMaster et al. ..... 366/168.2
4,840,732 A 6/1989 Rawlins
4,862,837 A 9/1989 Holmes
5,055,204 A 10/1991 Bogart
5,059,743 A 10/1991 Sakuma
5,102,803 A * 4/1992 Weaver ..... 435/290.2
5,152,212 A * 10/1992 Chauveau ..... 99/348
5,174,892 A 12/1992 Davis
5,313,915 A 5/1994 McDowell et al.
5,318,360 A * 6/1994 Langer et al. ..... 366/317
5,336,418 A 8/1994 Rawlins
5,642,937 A * 7/1997 Kuan ..... 366/106
6,016,839 A 1/2000 Raftis et al.
6,364,917 B1 4/2002 Matsumura et al.
6,382,170 B1 5/2002 Mang et al.
6,488,401 B1 * 12/2002 Seaman ..... 366/168.2
6,604,304 B1 8/2003 Slabach et al.
6,634,625 B1 10/2003 Sudrot
6,983,929 B2 * 1/2006 Shane ..... 261/79.2
7,059,759 B2 * 6/2006 Hummer ..... 366/137
7,252,429 B2 * 8/2007 Yungblut ..... 366/169.1
7,261,063 B1 8/2007 Holland
7,527,046 B1 * 5/2009 Valdez et al. ..... 123/549
7,654,231 B1 * 2/2010 Valdez et al. ..... 123/1 A
7,744,268 B2 * 6/2010 White et al. ..... 366/106
2002/0158141 A1 10/2002 Ryu
2004/0027913 A1 * 2/2004 Cockbain ..... 366/169.2
2005/0054522 A1 3/2005 Haskew
2006/0037919 A1 2/2006 Lara et al.
2007/0062496 A1 3/2007 Snower et al.
2009/0303829 A1 * 12/2009 Muecke ..... 366/101

FOREIGN PATENT DOCUMENTS

EP 462875 A1 * 12/1991

OTHER PUBLICATIONS

Jim Washburn, The Basics, Fill Your Tank with Vegetable Oil, Jun. 2, 2006, MSN Money, 6 pages.
Wikipedia, Straight Vegetable Oil, Jun. 2, 2006, 3 pages.
John Bush, Straight Vegetable Oil Fuel Systems, Jun. 2, 2006, Boulder Biodiesel, 3 pages.

* cited by examiner

SYSTEMS TO STORE AND AGITATE FUEL

CROSS REFERENCE TO RELATED APPLICATIONS

The present application is related to U.S. application Ser. No. 11/461,578, filed on Aug. 1, 2006 that has issued as U.S. Pat. No. 7,527,046 and U.S. application Ser. No. 11/461,618, filed on Aug. 1, 2006 that has issued as U.S. Pat. No. 7,654,231, the disclosures of which is incorporated herein by reference. Co-pending U.S. patent application Ser. No. 11/950,414, filed on Dec. 4, 2007 is being examined by Examiner Charles E. Cooley.

FIELD OF THE DISCLOSURE

Various embodiments of the disclosure pertain to a system and method for storing fuel and, more particularly, to a system and method which include a fuel storage tank and a fuel agitation system coupled to the fuel storage tank and operable to agitate a fuel that is stored in the fuel storage tank for use in a power generation system.

BACKGROUND

Storing fuel is well-known and readily appreciated by those of skill in the art. Typically, fuel is stored in a fuel storage tank for use by an engine coupled to the fuel storage tank in order to generate power. However, growing concerns about the environment along with concerns about fuel costs has begun a shift from petroleum based fuels to non-petroleum based organic fuels. The storing of these non-petroleum based organic fuels raises a number of issues.

Some non-petroleum based organic fuels such as, for example, vegetable oil, can stagnate when stored in a fuel storage tank. This stagnation can include the vegetable oil at least partially solidifying in the fuel storage tank, can prevent the vegetable oil from being used as a fuel by the engine, and can dirty the engine such that the engine requires frequent cleaning in order to be able to operate.

Accordingly, it would be desirable to provide for storing fuel absent the disadvantages discussed above.

SUMMARY

Various embodiments of the present disclosure are directed to systems and methods for storing fuel. The systems and methods provide techniques for agitating fuel stored in a fuel storage tank.

DETAILED DESCRIPTION

Figure 1:
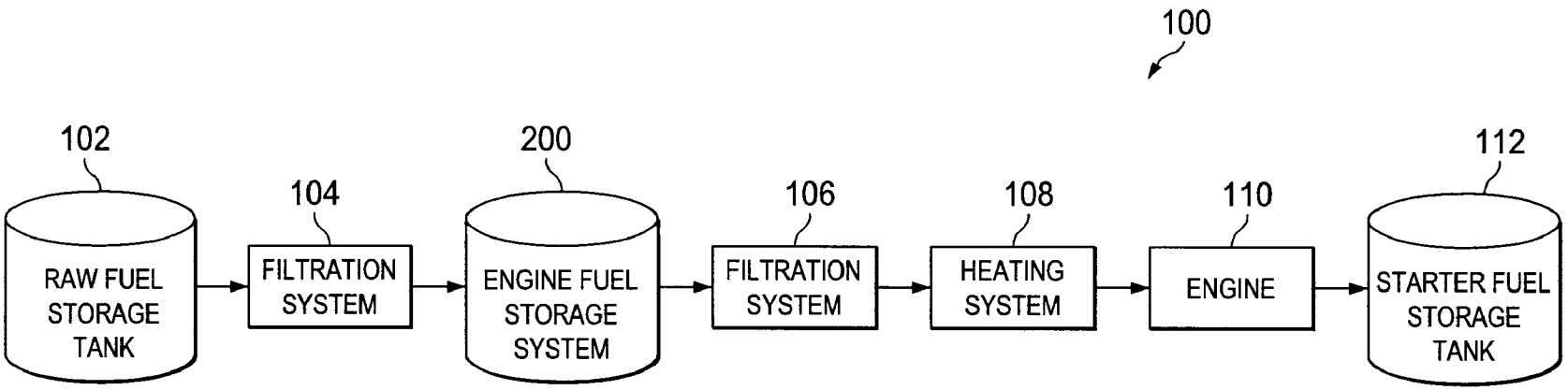
FIG. 1 is a schematic view illustrating an embodiment of a power generation system.
Figure 2A:
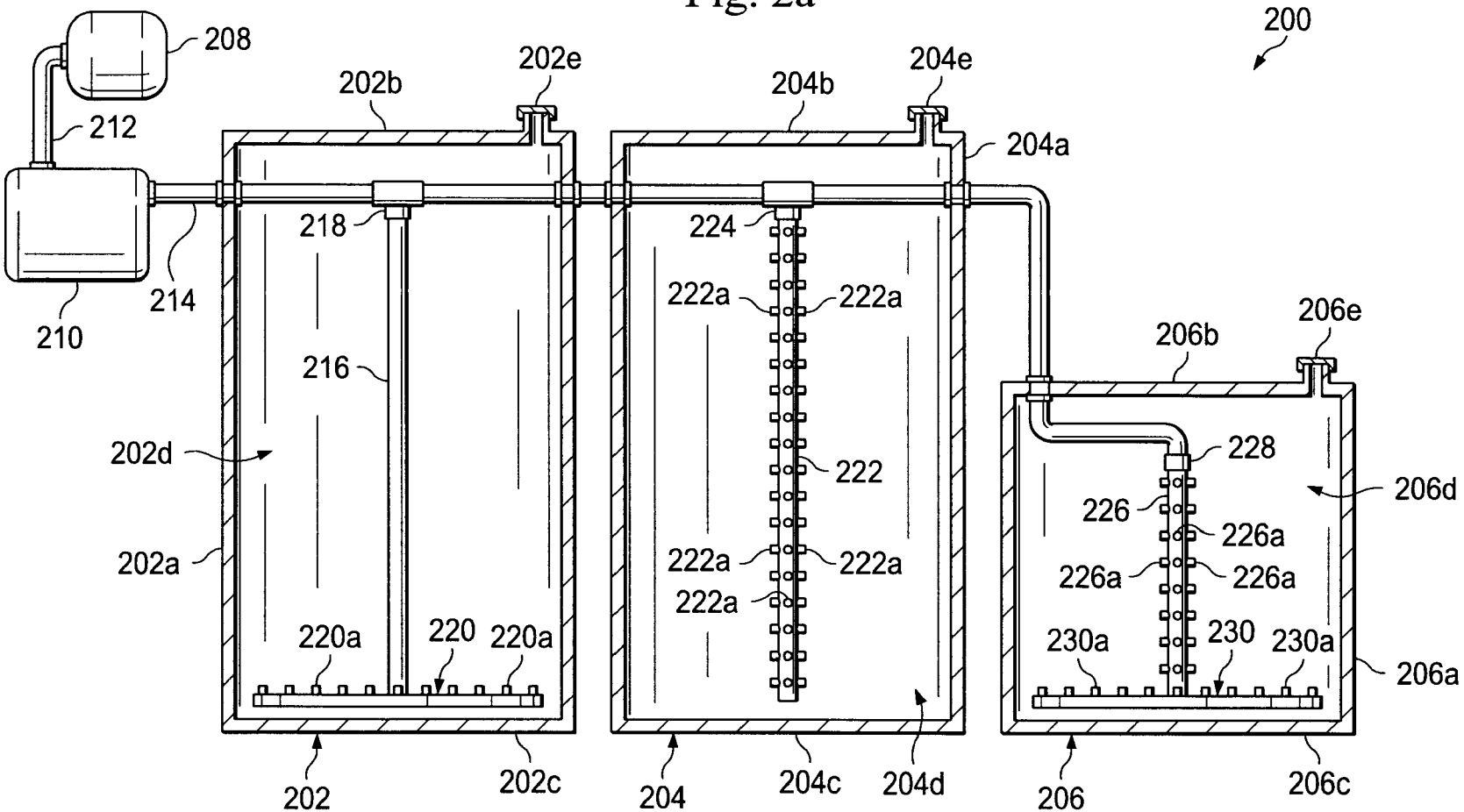
FIG. 2*a* is a side view illustrating an embodiment of engine fuel storage system used in the power generation system of FIG. 1.
Figure 2B:
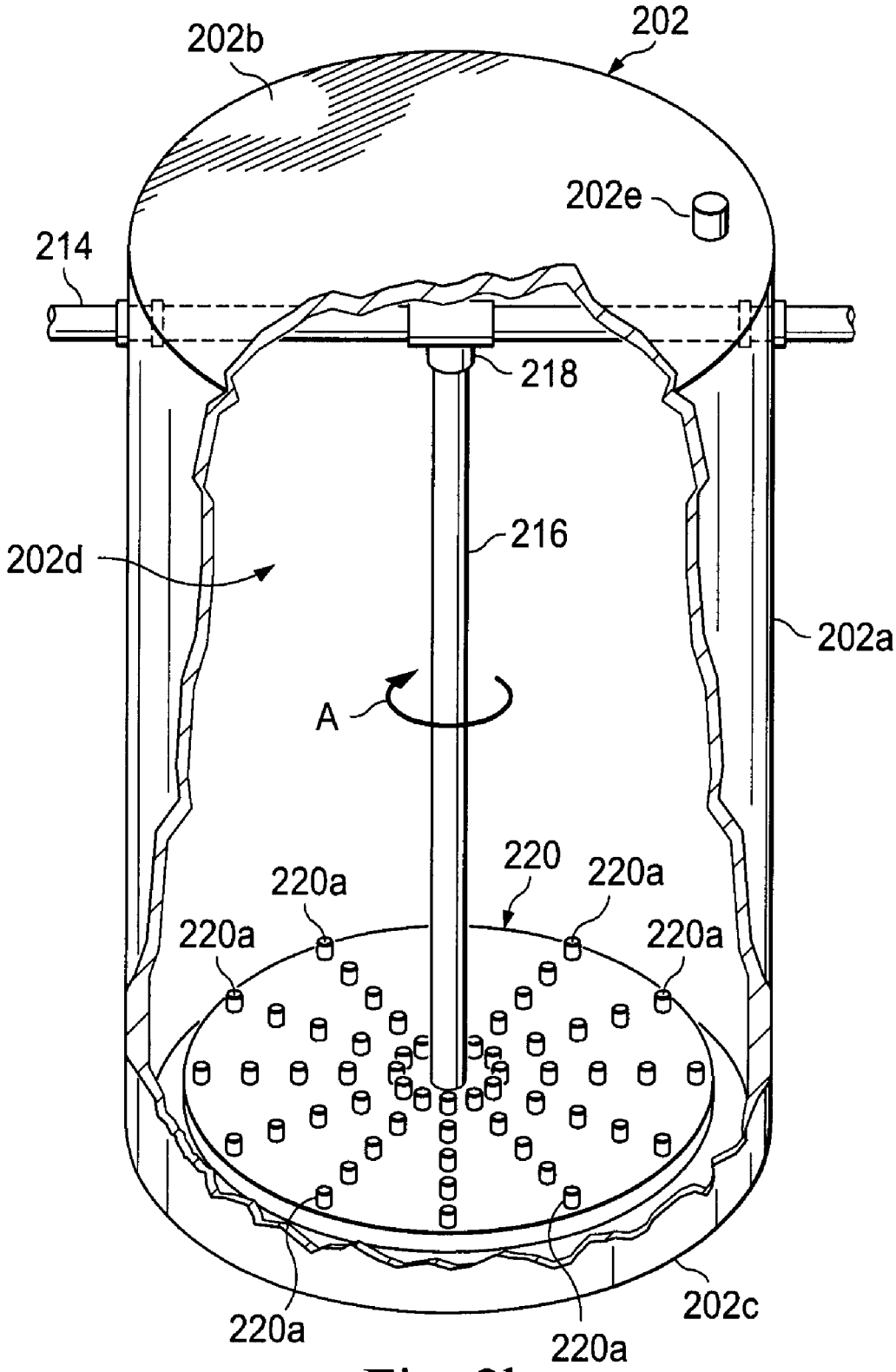
FIG. 2*b* is a perspective view illustrating an embodiment of a holding tank and fuel agitation system used in the engine fuel storage system of FIG. 2*a*.
Figure 2C:
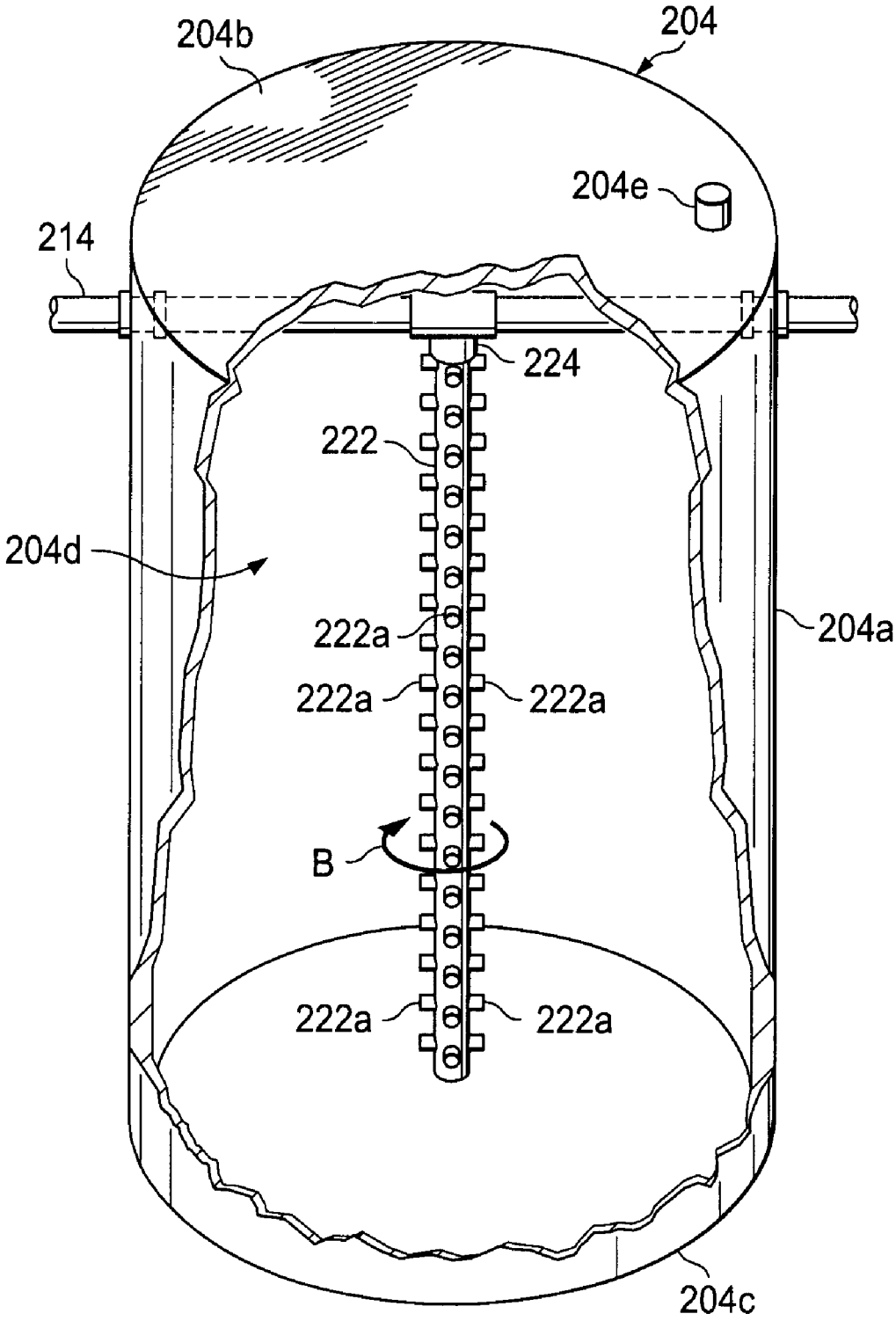
FIG. 2*c* is a perspective view illustrating an embodiment of a holding tank and fuel agitation system used in the engine fuel storage system of FIG. 2*a*.
Figure 2D:
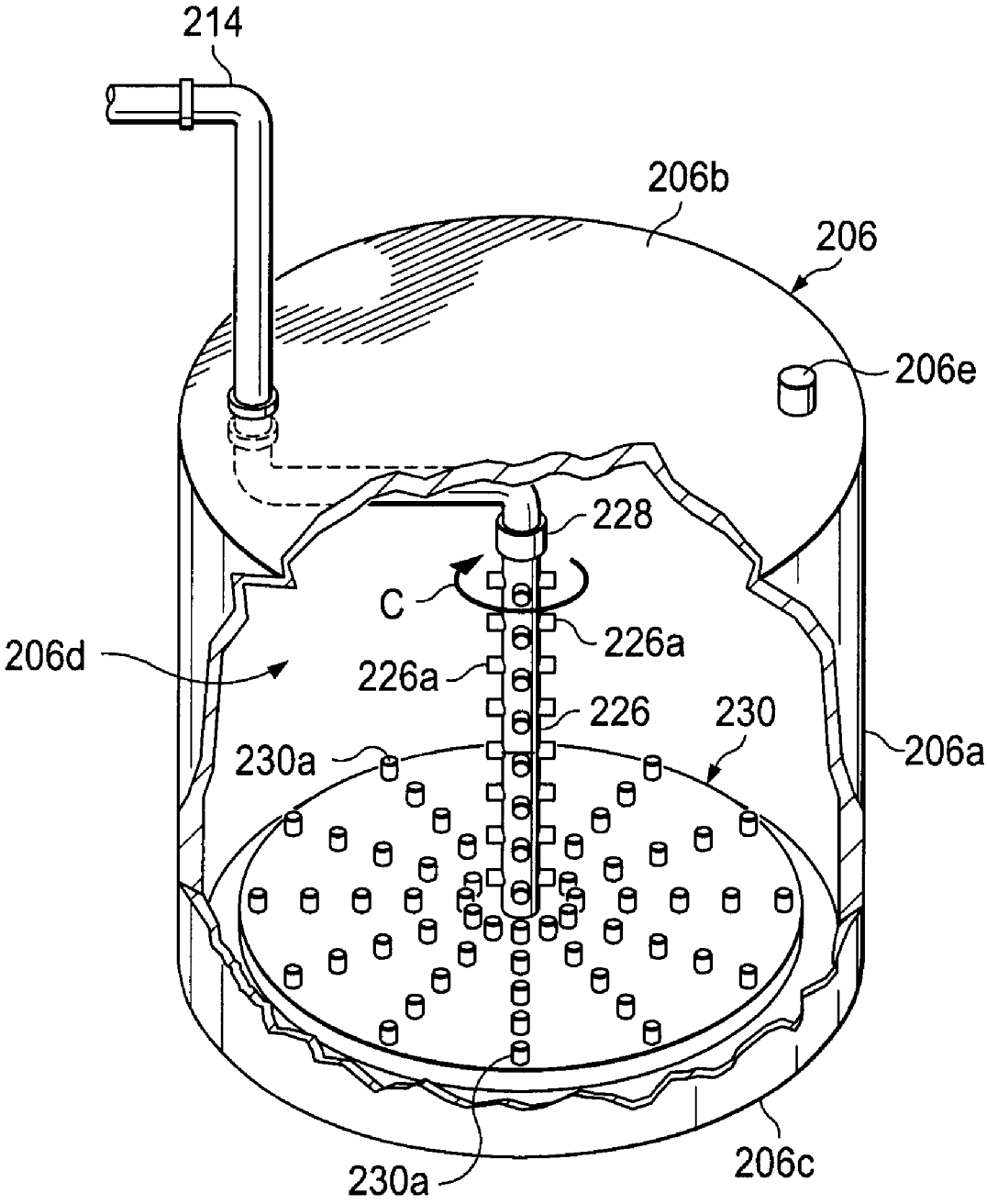
FIG. 2*d* is a perspective view illustrating an embodiment of a holding tank and fuel agitation system used in the engine fuel storage system of FIG. 2*a*.

Referring now to FIG. 1, a power generation system 100 is illustrated. The power generation system 100 includes a raw fuel storage tank 102. The raw fuel storage tank 102 is a convention fuel storage tank known in the art that is operable to store non-petroleum based organic fuels such as, for example, vegetable oil, peanut oil, corn oil, canola oil, and a variety of other non-petroleum based organic fuels known in the art. The raw fuel storage tank 102 is coupled to a filtration system 104 using methods known in the art such that raw fuel stored in the raw fuel storage tank 102 can be transferred from the raw fuel storage tank 102 to the filtration system 104. The filtration system 104 is a convention filtration system known in the art that is operable to filter impurities in raw fuel such as, for example, waste vegetable oils or other waste cooking oils, in order to convert the raw fuel into engine fuel. The filtration system 104 is coupled to an engine fuel storage system 200 using methods known in the art such that the raw fuel that has been converted to engine fuel can be transferred from the filtration system 104 to the engine fuel storage system 200. The engine fuel storage system 200 is a fuel storage tank that is operable to store non-petroleum based organic fuels such as, for example, vegetable oil, peanut oil, corn oil, canola oil, and a variety of other non-petroleum based organic fuels known in the art that have had impurities removed by the filtration system 104. In an embodiment, the engine fuel storage system 200 may not include the raw fuel storage tank 102 and the filtration system 104, and engine fuel that was either manufactured without impurities or filtered separate from the power generation system 100 may be stored in the engine fuel storage system 200. The engine fuel storage system 200 is coupled to a filtration system 106 using methods known in the art such that engine fuel stored in the engine fuel storage system 200 can be transferred from the engine fuel storage system 200 to the filtration system 106. The filtration system 106 is a conventional filtration system known in the art that is operable to filter impurities in the engine fuel that may have not been filtered by the filtration system 104, that may have been introduced to the engine fuel in the engine fuel storage system 200, or that may be present in the engine fuel for whatever reason.

The filtration system 106 is coupled to a heating system 108 using methods known in the art such that the engine oil that passes through the filtration system 106 from the engine fuel storage system 200 can be transferred from the filtration system 106 to the heating system 108. The heating system 108 is a convention heating system known in the art that is operable to heat the engine oil in order to lower its viscosity and prepare it for combustion. The heating system 108 is coupled to an engine 110 using methods known in the art such that the engine fuel that has been heated in the heating system 108 can be transferred from the heating system 108 to the engine 110. The engine 110 is a conventional engine that is operable to combust non-petroleum based organic fuels such as, for example, vegetable oil, peanut oil, corn oil, canola oil and a variety of other non-petroleum based organic fuels known in the art. In an embodiment, the engine 110 is a conventional diesel combustion engine. The engine 110 is coupled to a starter fuel storage tank 112 using methods known in the art such that the starter fuel stored in the start fuel storage tank 112 can be transferred from the starter fuel storage tank 112 to the engine 110. In an embodiment, the start fuel storage tank 112 is a conventional fuel storage tank known in the art that is operable to store petroleum based fuels such as, for example, diesel fuel.

Referring now to FIGS. 2*a*, 2*b*, 2*c* and 2*d*, the engine fuel storage system 200 is illustrated in more detail. In an embodiment, the engine fuel storage system 200 includes a plurality of holding tanks 202, 204, and 206. The holding tank 202 includes an elongated base 202*a* that extends between a top wall 202*b* and a bottom wall 202*c* located opposite the top wall 202*b* and defines a storage chamber 202*d* between the base 202*a*, the top wall 202*b*, and the bottom wall 202*c*. An air release valve 202*e* is located on the top wall 202*b* of the holding tank 202. The holding tank 204 includes an elongated base 204*a* that extends between a top wall 204*b* and a bottom wall 204*c* located opposite the top wall 204*b* and defines a storage chamber 204*d* between the base 204*a*, the top wall 204*b*, and the bottom wall 204*c*. An air release valve 204*e* is located on the top wall 204*b* of the holding tank 204. The holding tank 206 includes an elongated base 206*a* that extends between a top wall 206*b* and a bottom wall 206*c* located opposite the top wall 206*b* and defines a storage chamber 206*d* between the base 206*a*, the top wall 206*b*, and the bottom wall 206*c*. An air release valve 206*e* is located on the top wall 206*b* of the holding tank 206. A fuel agitation system is coupled to each of the holding tanks 202, 204, and 206 and includes an air filter 208 that is coupled to an air pump 210 through an air passageway 212 and an air passageway 214 extending from the air pump 212. The air filter 208 is a conventional air filter that is operable to remove impurities from air moved through it, and the air pump 210 is a conventional air pump that is operable to pump air filtered through the air filter 208 into the air passageway 214. The air passageway 214 enters the holding tank 202 though the base 202*a* adjacent the top wall 202*b* and extends through the storage chamber 202*d* until it exits the holding tank 202 through the base 202*a* adjacent the top wall 202*b*. The air passageway 214 then enters the holding tank 204 though the base 204*a* adjacent the top wall 204*b* and extends through the storage chamber 204*d* until it exits the holding tank 204 through the base 204*a* adjacent the top wall 204*b*. The air passageway 214 then enters the holding tank 206 though the top wall 206*b* and extends into the storage chamber 206*d*.

An air passageway 216 is coupled to the air passageway 214 by a coupling 218 and extends from a location adjacent the top wall 202*b* of the holding tank 202, through the storage chamber 202*d*, and to a location adjacent the bottom wall 202*c* of the holding tank 202. In an embodiment, the coupling 218 is a rotational coupling. An fuel agitation member 220 is coupled to the end of the air passageway 216 opposite the coupling 218 and, in an embodiment, includes a circular disk having a plurality of valves 220*a* extending from the fuel agitation member 220 and into the storage chamber 202*d*. An elongated fuel agitation member 222 is coupled to the air passageway 214 by a coupling 224 and extends from a location adjacent the top wall 204*b* of the holding tank 204, through the storage chamber 204*d*, and to a location adjacent the bottom wall 204*c* of the holding tank 204. In an embodiment, the coupling 222 is a rotational coupling. In an embodiment, the fuel agitation member 222 includes a plurality of valve 222*a* extending from the fuel agitation member 222 such that no additional intervening elements are between the valves and the elongated fuel agitation member and into the storage chamber 204*d*. A first fuel agitation member 226 is coupled to the air passageway 214 by a coupling 228 and extends from a location adjacent the top wall 206*b* of the holding tank 206, through the storage chamber 206*d*, and to a location adjacent the bottom wall 206*c* of the holding tank 206. In an embodiment, the coupling 228 is a rotational coupling. The first fuel agitation member 226 includes a plurality of valves 226*a* extending from the first fuel agitation member 228 and into the storage chamber 206*d*. A second fuel agitation member 230 is coupled to the end of the first fuel agitation member 226 opposite the coupling 228 and, in an embodiment, includes a circular disk having a plurality of valves 230*a* extending from the fuel agitation member 230 and into the storage chamber 206*d*.

Figure 3:
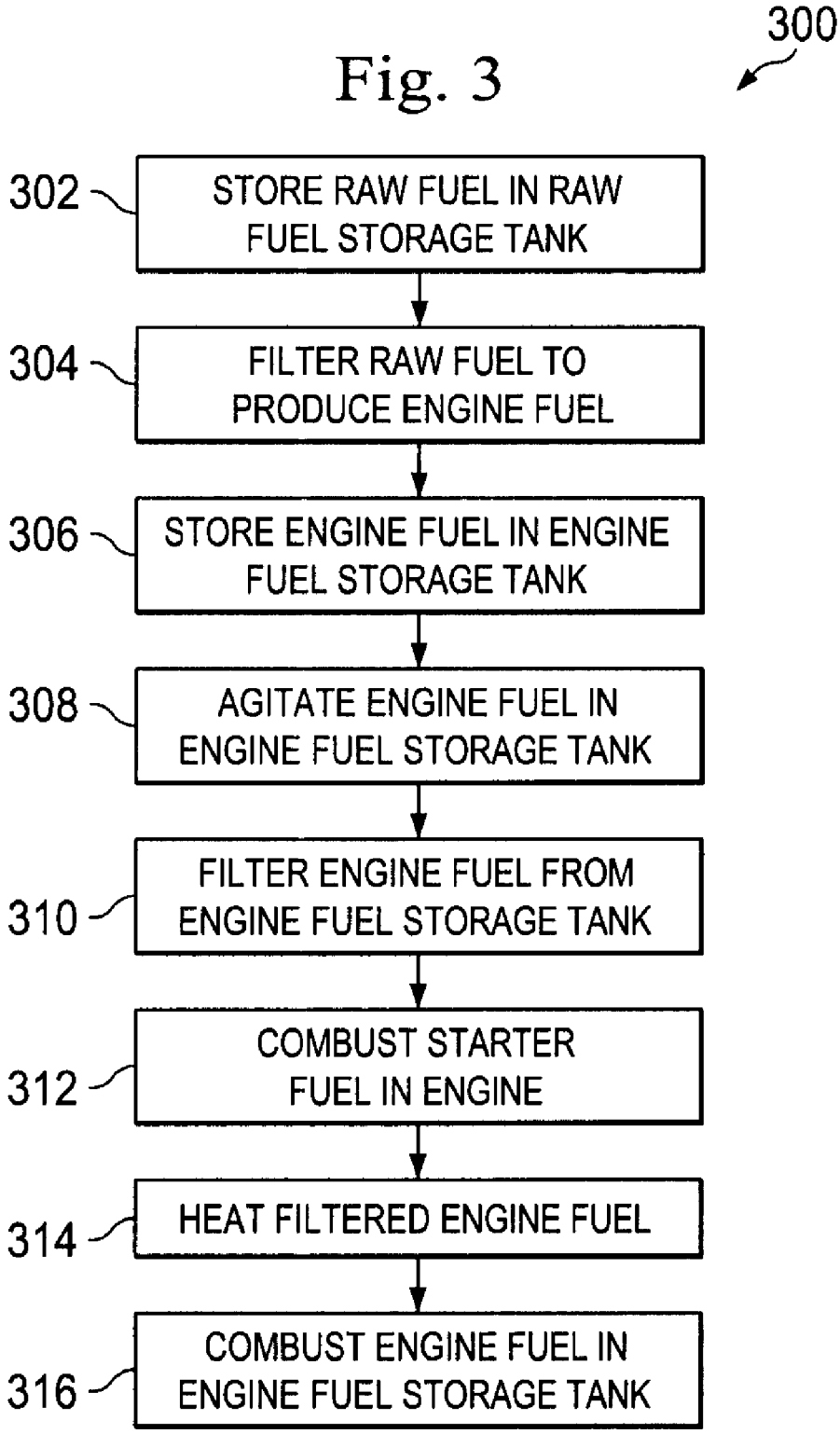
FIG. 3 is a flow chart illustrating an embodiment of a method for power generation.
Figure 4A:
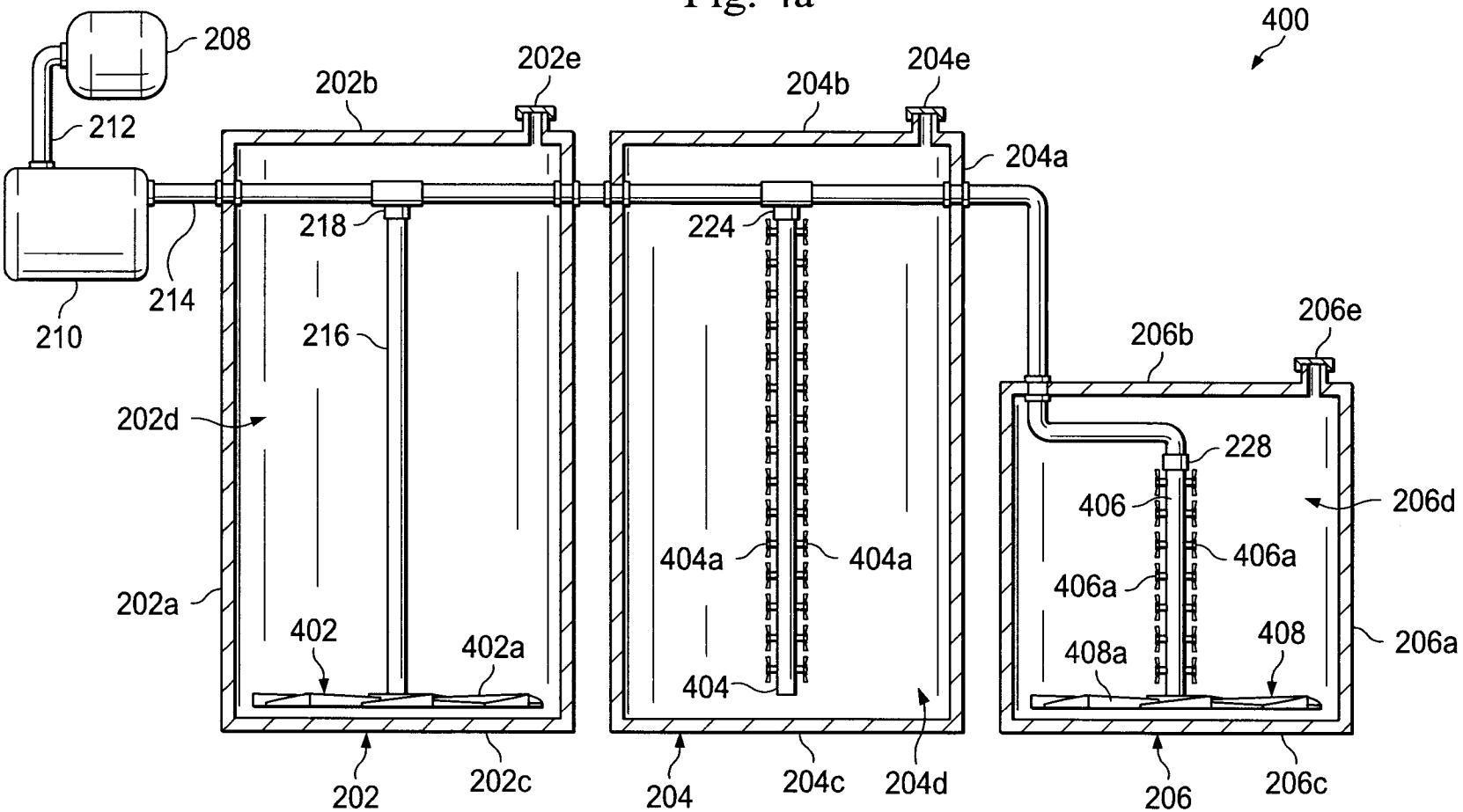
FIG. 4*a* is a side view illustrating an alternative embodiment of engine fuel storage system used in the power generation system of FIG. 1.
Figure 4B:
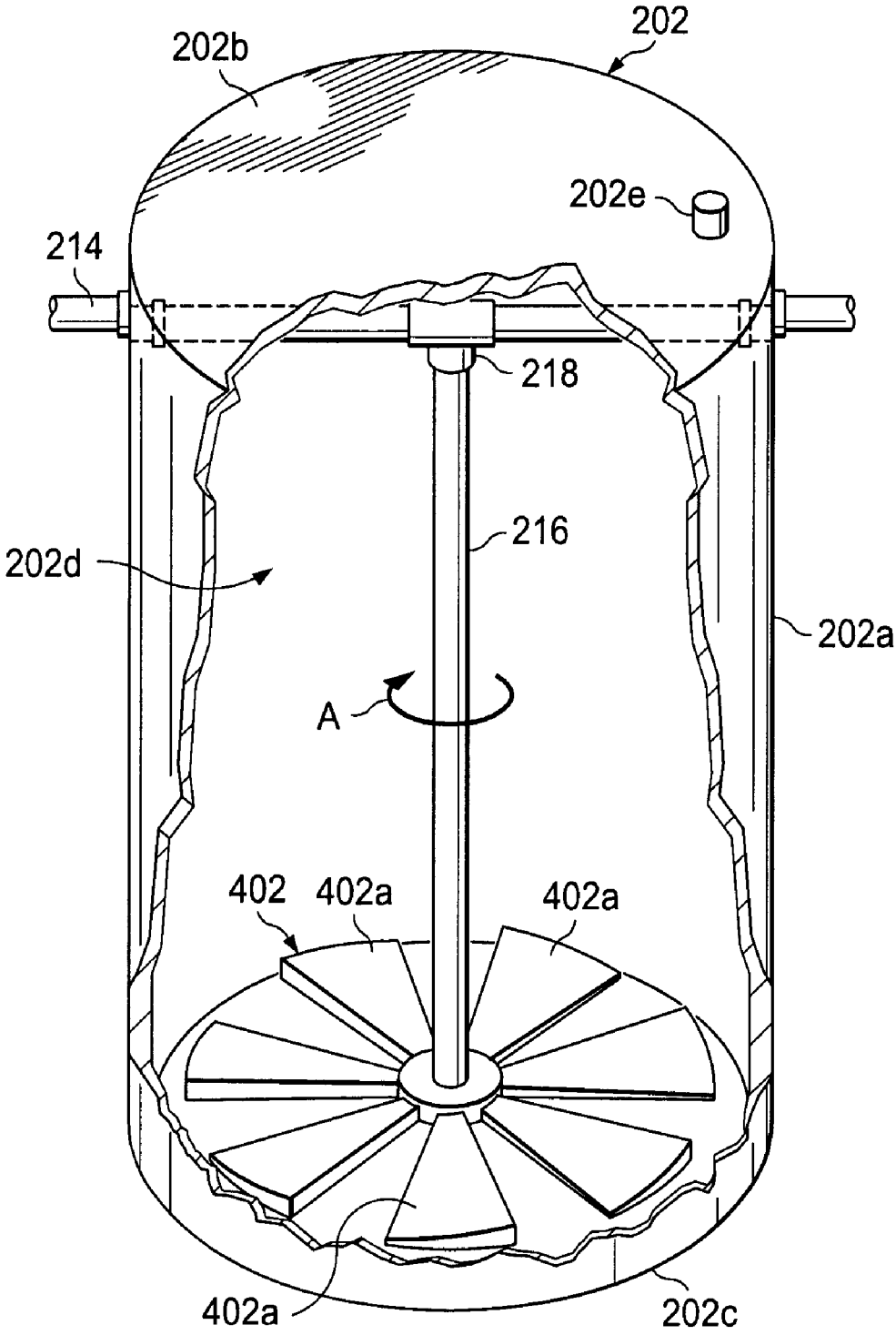
FIG. 4*b* is a perspective view illustrating an embodiment of a holding tank and fuel agitation system used in the engine fuel storage system of FIG. 4*a*.
Figure 4C:
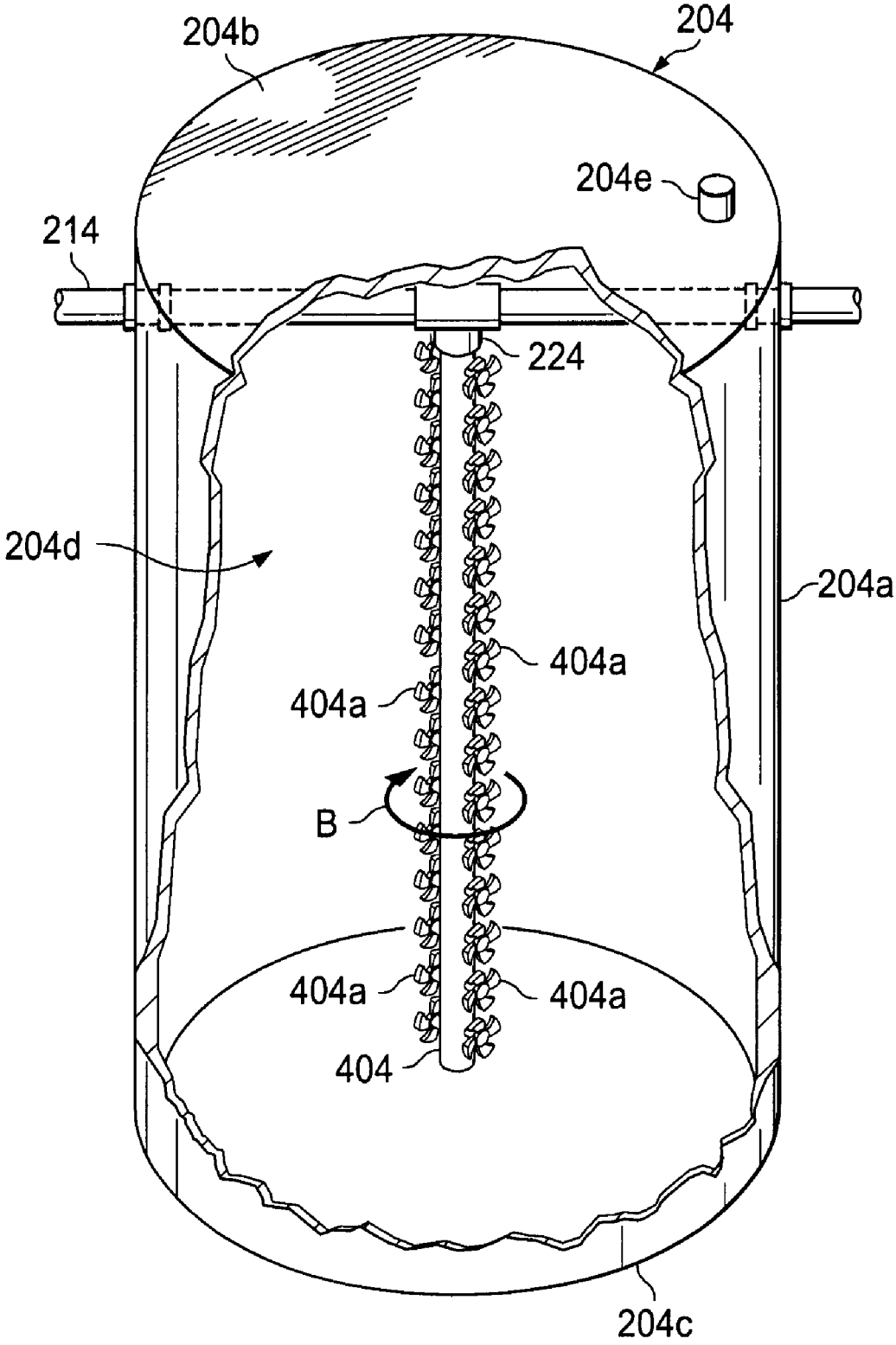
FIG. 4*c* is a perspective view illustrating an embodiment of a holding tank and fuel agitation system used in the engine fuel storage system of FIG. 4*a*.
Figure 4D:
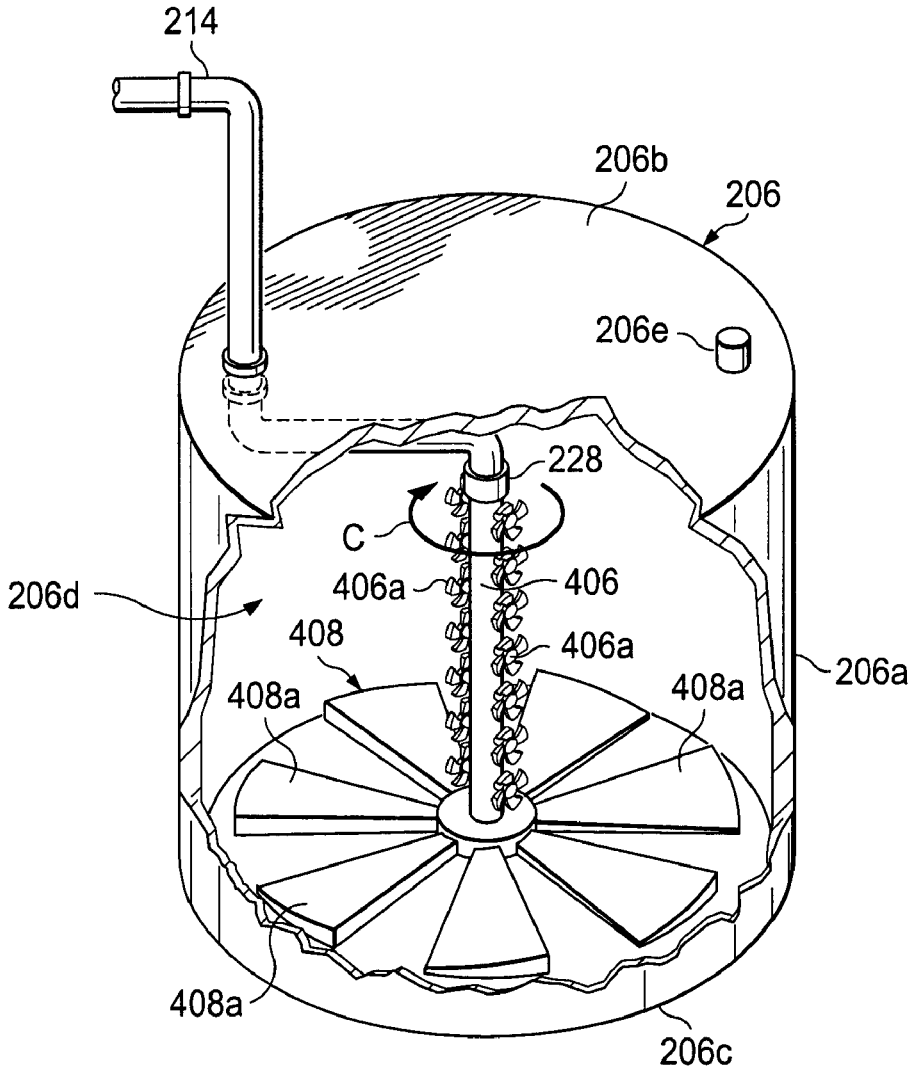
FIG. 4*d* is a perspective view illustrating an embodiment of a holding tank and fuel agitation system used in the engine fuel storage system of FIG. 4*a*.

Referring now to FIGS. 1 and 3, a method 300 for generating power is illustrated. The method 300 begins at step 302 where raw fuel is stored in the raw fuel storage tank 102. Raw fuel such as, for example, waste vegetable oil, waste peanut oil, waste corn oil, waste canola oil, combinations thereof, or a variety of other raw fuels known in the art, is collected and stored in the raw fuel tank 102. The method 300 then proceeds to step 304 where the raw fuel is filtered to produce engine fuel. The raw fuel in the raw fuel tank 102 is moved through the filtration system 104 in order to filter out impurities in the raw fuel. The filtration system 104 filters out impurities in the raw fuel such that the raw fuel is converted to engine fuel that may be combusted in the engine 110 without introducing any impurities into the engine 110 that might hinder the functions of the engine 110. The method 300 then proceeds to step 306 where engine fuel is stored in the engine fuel storage system 200. The engine fuel produced by filtering the raw fuel through the filtration system 104 is transferred to and stored in the engine fuel storage system 200 for use by the engine 200.

Referring now to FIGS. 1, 2*a*, 2*b*, 2*c*, 2*d* and 3, the method 300 proceeds to step 308 where engine fuel in the engine fuel storage system 200 is agitated. The engine fuel produced by filtering the raw fuel through the filtration system 104 in step 304 of the method 300 is stored in the holding tanks 202, 204 and 206. In an embodiment, the engine fuel is a fuel that will at least partially solidify without agitation. The air pump 210 is then activated in order to draw air through the air filter 208 and into the air pump 210. The air filter 208 filters out any impurities in the air that might contaminate the engine fuel that is stored in the holding tanks 202, 204 and 206. The air pump 210 moves the air filtered through the air filter 208 into the air passageway 214. Air may then travel from the air passageway 214 down through the air passageway 216 located in the holding tank 202 and into the fuel agitation member 220 such that air is released from the plurality of valves 220*a* and into the engine fuel located in the storage chamber 202*d*. The air moves through the engine fuel located in the storage chamber 202*d* and agitates the engine fuel to prevent the engine fuel from stagnating, solidifying, and/or becoming unsuitable for combustion by the engine 110. In an embodiment, the coupling 218 is a rotatable coupling that is actuated by the air flow between the air passageway 214 and the air passageway 216 such that the air passageway 216 rotates in a direction A as air is released from the plurality of valves 220*a*. Air released from the plurality of valves 220*a* and into the storage chamber 202*d* may be released from the storage chamber 202*d* by the air valve 202*e* located on the top wall 202*b* of the holding tank 202.

Air may also travel from the air passageway 214 down through the fuel agitation member 222 located in the holding tank 204 such that air is released from the plurality of valves 222*a* and into the engine fuel located in the storage chamber 204*d*. The air moves through the engine fuel located in the storage chamber 204*d* and agitates the engine fuel to prevent the engine fuel from stagnating, solidifying, and/or becoming unsuitable for combustion by the engine 110. In an embodiment, the coupling 224 is a rotatable coupling that is actuated by the air flow between the air passageway 214 and the fuel agitation member 222 such that the fuel agitation member 222 rotates in a direction B as air is released from the plurality of valves 222*a*. Air released from the plurality of valves 222*a* and into the storage chamber 204*d* may be released from the storage chamber 204*d* by the air valve 204*e* located on the top wall 204*b* of the holding tank 204. Air may also travel from the air passageway 214 down through the first fuel agitation member 226 located in the holding tank 206 and into the second fuel agitation member 230 such that air is released from the plurality of valves 226*a* and 230*a* and into the engine fuel located in the storage chamber 206*d*. The air moves through the engine fuel located in the storage chamber 206*d* and agitates the engine fuel to prevent the engine fuel from stagnating, solidifying, and/or becoming unsuitable for combustion by the engine 110. In an embodiment, the coupling 228 is a rotatable coupling that is actuated by the air flow between the air passageway 214 and the fuel agitation member 226 such that the fuel agitation member 226 rotates in a direction C as air is released from the plurality of valves 226*a* and 230*a*. Air released from the plurality of valves 226*a* and 230*a* and into the storage chamber 206*d* may be released from the storage chamber 206*d* by the air valve 206*e* located on the top wall 206*b* of the holding tank 206.

Referring now to FIGS. 1 and 3, the method 300 proceeds to step 310 where engine fuel from the engine fuel storage system 200 is filtered. The engine fuel in the engine fuel storage system 200 is moved through the filtration system 106 in order to filter out impurities in the engine fuel. The filtration system 108 filters out impurities in the engine fuel such that the engine fuel may be combusted in the engine 110 without introducing any impurities into the engine 110 that might hinder the functions of the engine 110. The method 300 then proceeds to step 312 where starter fuel is combusted in the engine 110. In an embodiment, the engine 110 combusts starter fuel stored in the starter fuel storage tank 112 in order to start the engine 110 and power the heating system 108. The method 300 then proceeds to step 314 where the filtered engine oil is heated. The engine oil filtered through the filtration system 106 in step 310 of the method 300 is heated by the heating system 108 in order to lower the viscosity of the engine oil such that it is suitable for combustion in the engine 110. The method then proceeds to step 316 where the engine oil is combusted in the engine 110. The engine 110 combusts engine fuel from the heating system 108 and converts the thermal energy from combustion into mechanical energy in order to provide power.

Referring now to FIGS. 4*a*, 4*b*, 4*c* and 4*d*, in an alternative embodiment, an engine fuel storage system 400 is substantially similar in design and operation to the engine fuel storage system 200, described above with reference to FIGS. 1, 2*a*, 2*b*, 2*c*, 2*d*, 2*e* and 3, with the provision of an fuel agitation member 402 replacing the fuel agitation member 220, an fuel agitation member 404 replacing the fuel agitation member 222, and a first fuel agitation member 406 and a second fuel agitation member 408 replacing the first fuel agitation member 226 and the second fuel agitation member 230, respectively. The fuel agitation member 402 includes a plurality of fluid flow creation devices 402*a*. The fuel agitation member 404 includes a plurality of fluid flow creation devices 404*a*. The first fuel agitation member 406 and the second fuel agitation member 408 include a plurality of fluid flow creation devices 406*a* and 408*a*, respectively. In operation, the engine fuel storage system 400 operates substantially similarly to the engine fuel storage system 200 according to the method 300, with the provision of a modified step 308. During the modified step 308, air may be used to actuate the rotatable coupling 218 such that the air passageway 216 rotates in the direction A and allows the fluid flow creation member 402*a* to agitate the engine fuel to prevent the engine fuel from stagnating, solidifying, and/or becoming unsuitable for combustion by the engine 110. Air released into the storage chamber 202*d* during this process may be released from the storage chamber 202*d* by the air valve 202*e* located on the top wall 202*b* of the holding tank 202.

Air may also travel from the air passageway 214 down through the fuel agitation member 404 located in the holding tank 204 to actuate the fluid flow creation devices 404*a* such that the fluid flow creation devices 404*a* agitate the engine fuel to prevent the engine fuel from stagnating, solidifying, and/or becoming unsuitable for combustion by the engine 110. In an embodiment, the coupling 224 is a rotatable coupling that is actuated by the air flow between the air passageway 214 and the fuel agitation member 404 such that the fuel agitation member 404 rotates in a direction B as the fluid flow creation devices 404*a* agitate the engine fuel. Air released into the storage chamber 204*d* during this process may be released from the storage chamber 204*d* by the air valve 204*e* located on the top wall 204*b* of the holding tank 204. Air may also travel from the air passageway 214 down through the first fuel agitation member 406 located in the holding tank 206 to actuate the fluid flow creation devices 406*a* while air is also used to actuate the rotatable coupling 228 to rotate the first fuel agitation member 406 and the second fuel agitation member 408 in a direction C such that the fluid flow creation devices 408*a* and 406*a* agitate the engine fuel to prevent the engine fuel from stagnating, solidifying, and/or becoming unsuitable for combustion by the engine 110. In an embodiment, a combination of the fuel agitation members 220, 222, 226, 230, 402, 404, 406 and 408 may be used in the engine fuel storage system 200 or 400. Furthermore, while the engine fuel storage systems 200 and 400 are illustrated and described using air to power the fuel agitation system pneumatically, one of skill in the art will recognize that hydraulic power, mechanical power, or a variety of other power systems may be used to power the fuel agitation system in order to agitate fuel in the engine fuel storage system 200 or 400.

Figure 5:
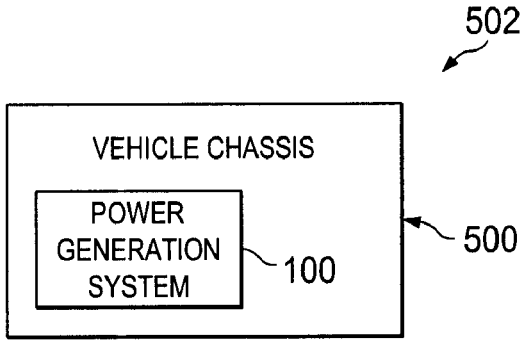
FIG. 5 is a perspective view illustrating an embodiment of a vehicle using the power generation system of FIG. 1.

Referring now to FIG. 5, in an alternative embodiment, the power generation system 100, described above with reference to FIGS. 1, 2*a*, 2*b*, 2*c*, 2*d*, 3, 4*a*, 4*b*, 4*c* and 4*d*, may be located in a vehicle chassis 500, with the engine 110, the raw fuel storage tank 102, the starter fuel storage tank 112, and the engine fuel storage system 200 mounted to the vehicle chassis 500, in order to provide power to a vehicle 502. In an embodiment, the vehicle 502 may be, for example, an automobile.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A fuel storage system, comprising:

a fuel storage tank including an air valve; and a fuel agitation system coupled to the fuel storage tank and operable to agitate a fuel that is stored in the fuel storage tank, wherein the fuel agitation system includes:

an elongate fuel agitation member, wherein the elongate fuel agitation member includes:

a lumen that extends between a first end and a second end of the elongate fuel agitation member, wherein the second end is opposite the first end; and a plurality of valves extending from the elongate fuel agitation member such that no additional intervening elements are between the valves and the elongate fuel agitation member, wherein the valves are distributed along the elongate fuel agitation member from the first end to the second end of the elongate fuel agitation member and the valves are in fluid communication with the fuel; and an air passageway in fluid communication with the elongate fuel agitation member, wherein the air passageway is coupled to the first end of the elongate fuel agitation member by a rotational coupling located in the fuel storage tank, wherein the rotational coupling is between the air passageway and the elongate fuel agitation member and is pneumatically actuated by air flow exiting the valves to rotate the elongate fuel agitation member as the air flow is introduced via the plurality of valves into the fuel storage tank, wherein the introduced air flow exits the fuel storage chamber out of the air valve.

2. The system of claim 1, wherein the fuel agitation system is operable to agitate a vegetable oil fuel that is stored in the fuel storage tank.

3. The system of claim 1, wherein the fuel agitation system is operable to agitate a fuel that is stored in the fuel storage tank and that is chosen from the group consisting of a vegetable oil fuel, a peanut oil fuel, a corn oil fuel, a canola oil fuel, and combinations thereof.

4. The system of claim 1, wherein the fuel agitation system is operable to agitate a fuel that will at least partially solidify without agitation.

5. The system of claim 1, wherein the fuel agitation system comprises an air pump and is operable to agitate a fuel stored in the fuel storage tank using air pumped by the air pump.

6. The system of claim 5, wherein the fuel agitation system is operable to pump air with the air pump into a fuel stored in the fuel storage tank in order to agitate the fuel.

7. The system of claim 5, wherein the fuel agitation system is operable to pump air with the air pump to pneumatically power a fluid flow creation device in order to agitate a fuel stored in the fuel storage tank.

8. The system of claim 5, wherein the fuel agitation system is operable to pump air with the air pump to rotate the elongate fuel agitation member.

9. The system of claim 1, further comprising:

a fuel stored in the fuel storage tank.

10. The system of claim 9, wherein the fuel is a vegetable oil fuel.

11. The system of claim 9, wherein the fuel is chosen from the group consisting of a vegetable oil fuel, a peanut oil fuel, a corn oil fuel, a canola oil fuel, and combinations thereof.

12. The system of claim 9, wherein the fuel comprises a fuel that will at least partially solidify without agitation.

13. A fuel storage system, comprising:

means for storing fuel including an air valve; and means for agitating a fuel stored in the means for storing fuel coupled to the means for storing fuel, wherein the means for agitating the fuel includes:

an elongate fuel agitation member, wherein the elongate fuel agitation member includes:

a lumen that extends between a first end and a second end of the elongate fuel agitation member, wherein the second end is opposite the first end; and a plurality of valves extending from the elongate fuel agitation member such that no additional intervening elements are between the valves and the elongate fuel agitation member, wherein the valves are distributed along the elongate fuel agitation member from the first end to the second end of the elongate fuel agitation member and the valves are in fluid communication with the fuel; and an air passageway in fluid communication with the elongate fuel agitation member, wherein the air passageway is coupled to the first end of the elongate fuel agitation member by a rotational coupling located in the fuel storage tank, wherein the rotational coupling is between the air passageway and the elongate fuel agitation member and is pneumatically actuated by air flow exiting the valves to rotate the elongate fuel agitation member as the air flow is introduced via the plurality of valves into the fuel storage tank, wherein the introduced air flow exits the fuel storage chamber out of the air valve.

14. The system of claim 13, wherein the means for agitating a fuel is operable to agitate a fuel that comprises means for at least partially solidifying without agitation.

15. The system of claim 13, wherein the means for agitating a fuel comprises means for pumping air into the means for storing fuel.

16. The system of claim 13, wherein the means for agitating a fuel comprises means for creating a fluid flow.

17. The system of claim 13, further comprising:

a fuel stored in the means for storing fuel.

* * * * *